US005987678A

United States Patent [19]

Ayers

[11] Patent Number: 5,987,678

[45] Date of Patent: Nov. 23, 1999

[54] MULTIPLE FIRMNESS MATTRESS

[75] Inventor: William L. Ayers, Northridge, Calif.

[73] Assignee: Simmons Company, Atlanta, Ga.

[21] Appl. No.: 08/438,888

[22] Filed: May 10, 1995

[51] Int. Cl.[6] ..... A47C 27/04

[52] U.S. Cl. ..... 5/720; 5/716; 5/727; 5/738; 5/655.8

[58] Field of Search ..... 5/471, 464, 475, 5/477

[56] References Cited

U.S. PATENT DOCUMENTS

| | | | |
|---|---|---|---|
| 2,629,111 | 2/1953 | Korney | 5/464 |
| 2,651,788 | 9/1953 | Forwood | 5/464 |
| 3,608,107 | 9/1971 | Kentor et al. | 5/475 |
| 3,981,034 | 9/1976 | MacMorran et al. | 5/475 |
| 4,234,983 | 11/1980 | Stumpf . | |
| 4,234,984 | 11/1980 | Stumpf | 5/477 |
| 4,401,501 | 8/1983 | Stumpf . | |
| 4,439,977 | 4/1984 | Stumpf | 53/428 |
| 4,449,261 | 5/1984 | Magnusson . | |
| 4,578,834 | 4/1986 | Stumpf | 5/475 |

FOREIGN PATENT DOCUMENTS

| | | | |
|---|---|---|---|
| 0218554 | 2/1985 | Germany | 5/464 |

*Primary Examiner*—Terry Lee Melius
*Assistant Examiner*—Robert G. Santos
*Attorney, Agent, or Firm*—Jones, Day, Reavis & Pogue

[57] ABSTRACT

A unitary mattress assembly comprises a plurality of coil springs interarranged to define a single innerspring core having a generally rectangular shape in plan. The core has a first portion which is sized to accommodate a first sleeping person and comprises coil springs having a first preselected compressive strength. Adjacent to the first portion is a second core portion sized to accommodate another sleeping person and having coil springs of a different compressive strength than the springs of the first portion. By the foregoing construction, a mattress may be manufactured having a single innerspring core but having two regions of differing firmness to suit the particular preferences of two people.

5 Claims, 3 Drawing Sheets

MULTIPLE FIRMNESS MATTRESS

BACKGROUND OF THE INVENTION

1. Field of the Invention

The present invention relates generally to mattress constructions and, more particularly, to a unitary mattress assembly for use in bedding having an innerspring construction wherein springs of differing compressive strength are used to provide a mattress surface with a plurality of regions of different firmness.

2. Description of the Prior Art

A standard bed construction which has been popular for some time includes a frame for supporting a box spring. The box spring, in turn, is designed to support a mattress. Mattresses are available in a variety of sizes and are also constructed in various ways. One such construction which has proved to be highly desirable includes the use of an innerspring comprising a plurality of discrete coil springs encapsulated in individual fabric pockets joined together in a string. An assembly of this type is known as Marshall construction and is disclosed, for example, in U.S. Pat. No. 4,234,983, issued to Stumpf and assigned to the common assignee herein, the disclosure of which is expressly incorporated herein by reference. Pocketed strings of coils can be readily manufactured by apparatus disclosed, for example, in U.S. Pat. No. 4,401,501 also issued to Stumpf and assigned to the common assignee herein, the disclosure of which is likewise incorporated herein by reference. In essence, the latter patent teaches producing a string of pocketed coil springs by inserting the coils into spring pockets formed by ultrasonic welding of a tube of appropriate heat sensitive fabric. Once the strings of coils are formed, they may be arranged in any desired fashion such as a chevron or other pattern to provide an innerspring assembly in which the individual springs all have longitudinal axes oriented parallel one to another and the springs are closely packed together in an array having a generally rectangular shape in plan with the ends of the springs lying in a common plane. A suitable quilted foam pad of preselected thickness may then be used to cover the innerspring and provide a generally planar surface on which a person can sleep. Preferably, the innerspring is covered on both sides and has fabric edging connecting the opposed surface covers, thereby defining a unitary mattress assembly.

Mattresses of the foregoing type are generally available with differing degrees of firmness to suit the particular preference of the user. However, known unitary mattresses which are sized for two people, such as full, queen or king size mattresses, have heretofore had only one degree of firmness common to both sides of the mattress. This construction requires one user to compromise his or her preference as to firmness if another user has a different preference. To provide a bed for two people having dual firmness, it is known to construct a continuous border defining a central cavity into which two separate core mattresses are inserted, thereby providing for different degrees of mattress firmness to suit the individual preferences of two users. Such a bed construction is shown, for example, in U.S. Pat. No. 4,449,261 issued to Magnusson and assigned to the common assignee herein. However, a disadvantage of such a bed construction is that there are discernable gaps or cracks defined between the border and the mattresses inserted therewithin, as well as between the dual mattress cores themselves, which can be uncomfortable and/or inconvenient for the users. Moreover, this type of bed construction is somewhat complicated and expensive in manufacture.

Accordingly, it is desirable to provide a unitary mattress assembly having selectively positioned, multiple firmness regions therein without requiring a construction involving separate mattress cores. It is further desirable to provide a unitary mattress assembly having multiple, preferably dual firmness which can be manufactured at a cost comparable to conventional single firmness mattresses.

SUMMARY OF THE INVENTION

The present invention improves over the prior art by providing a unitary mattress assembly comprising a plurality of coil springs arranged to define a single mattress core, preferably having a generally rectangular shape in plan. In a most preferred embodiment of this invention, the core includes a first portion which is sized to accommodate a first sleeping person and comprises coil springs having a first preselected compressive strength. Adjacent to the first portion is a second core portion sized to accommodate another sleeping person and having coil springs of a different compressive strength than the springs of the first portion. By the foregoing construction, a mattress may be manufactured having a single innerspring core but having two regions of differing firmness to suit the particular preferences of two people. Likewise, by proper positioning of a plurality of interconnected coil strings assembled from coil springs having divergent compressive strengths, it is possible to assemble a multiple firmness mattress custom designed to the specification of any individual users.

BRIEF DESCRIPTION OF THE DRAWINGS

The foregoing and other novel features of the invention will be better understood upon a reading of the following detailed description taken in conjunction with the accompanying drawings wherein.

DETAILED DESCRIPTION OF THE PREFERRED EMBODIMENT

Figure 1:
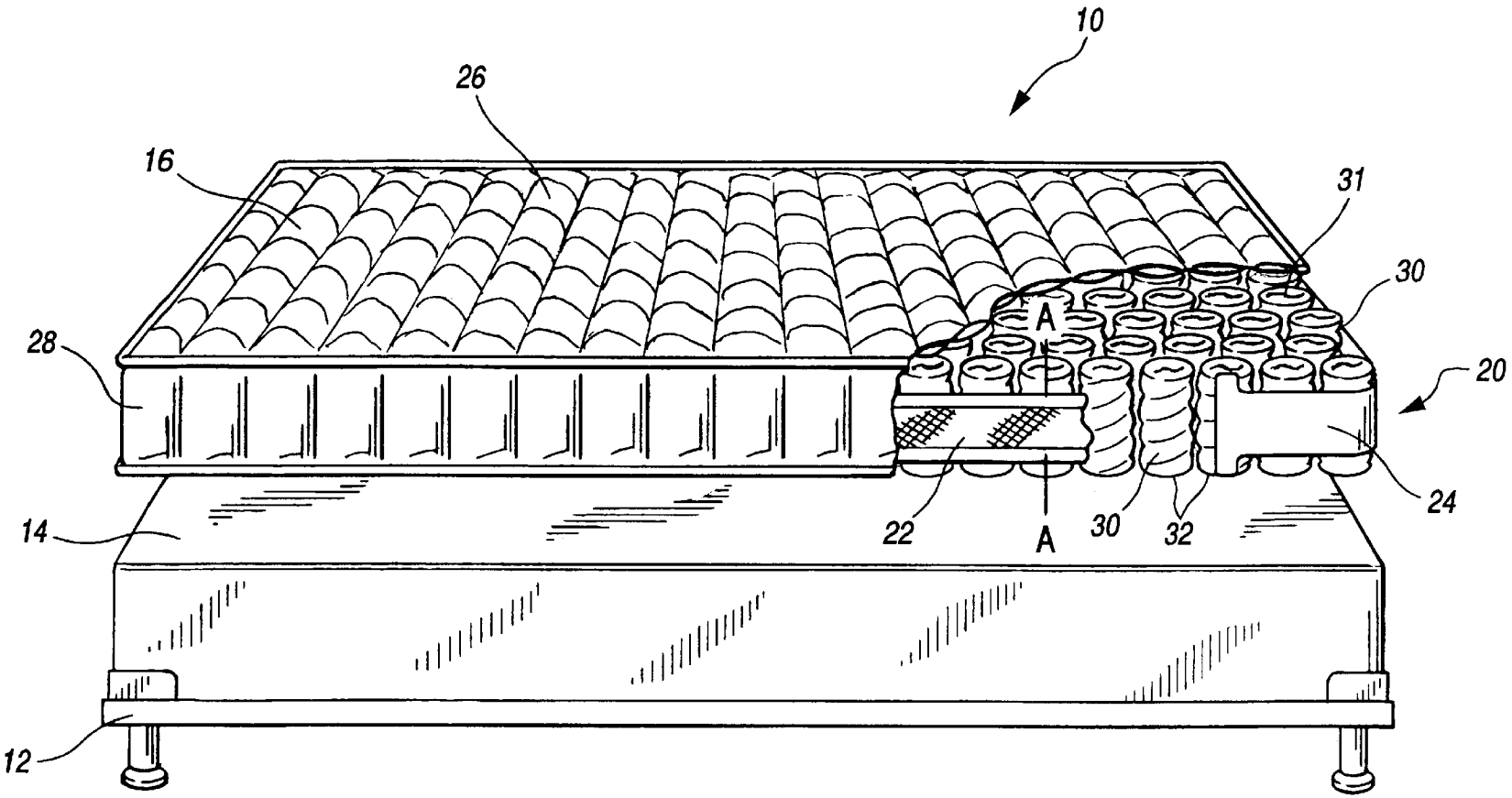
FIG. 1 is a perspective view, partially broken away, of a bed comprising a mattress constructed in accordance with the invention.

Referring now to the drawings, and initially to FIG. 1, a bed is designated generally by the reference numeral 10 and comprises a frame assembly 12, a box spring 14 and a mattress 16. Preferably the mattress 16 is constructed in a manner well-known in the art and includes a plurality of pocketed coil springs 30, as will be described in detail hereinafter, arranged in an array having a generally rectangular shape in plan. As seen in FIG. 1, the coils 30 are closely packed together with their longitudinal axes A—A all parallel one to another and with their longitudinal ends 31, 32 all lying in a common plane thereby defining an innerspring assembly or core 20. A suitable containment strap 22 and corner members 24 may be used to reinforce the shape of the core 20. In a well-known manner the core 20 is covered with a panel 26 which may be a quilted assembly of foam and fabric, thereby defining a sleeping surface. Although not shown in FIG. 1, the mattress may have an underside which is identical in construction to the top side and which includes a quilted cover likewise coextensive with the innerspring core. The top side cover panel 26 is joined to the underside cover panel by continuous edging 28 consisting of fabric.

Figure 2:
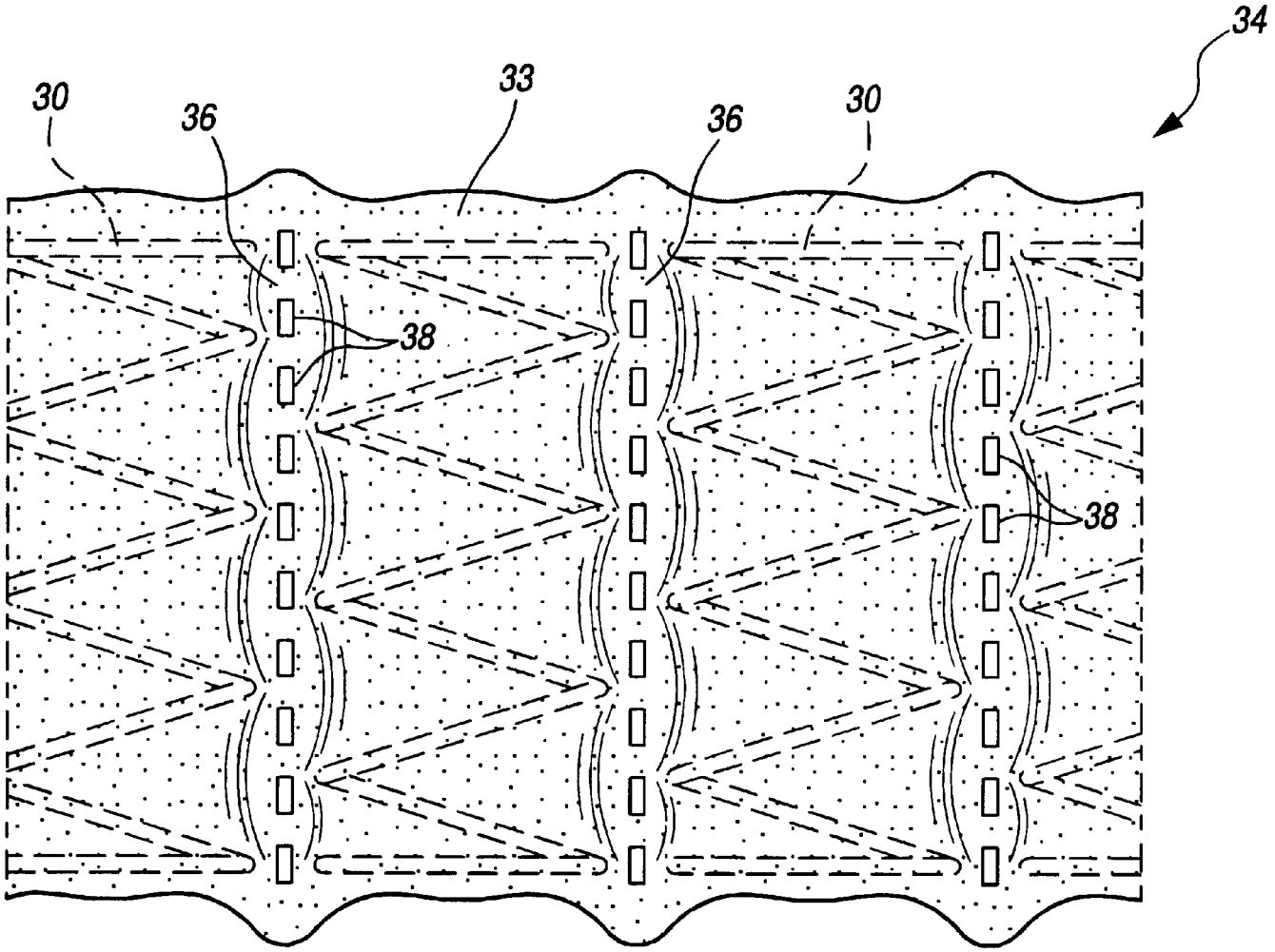
FIG. 2 is a fractional side view of a string of coil springs of a type used in the mattress shown in FIG. 1.

Turning now to FIG. 2, the innerspring core construction 20 can be seen to include a plurality of coil springs 30 each encapsulated in an individual pocket of fabric 33. Preferably, the pockets are formed from a tube of heat sensitive fabric 33, as an elongated continuous string 34, by ultrasonically welding the fabric 33 at webs 36 formed between adjacent springs 30. Welds 38 are preferably made at spaced intervals along the webs 36 to assure adequate strength of the assembled string 34.

Figure 3:
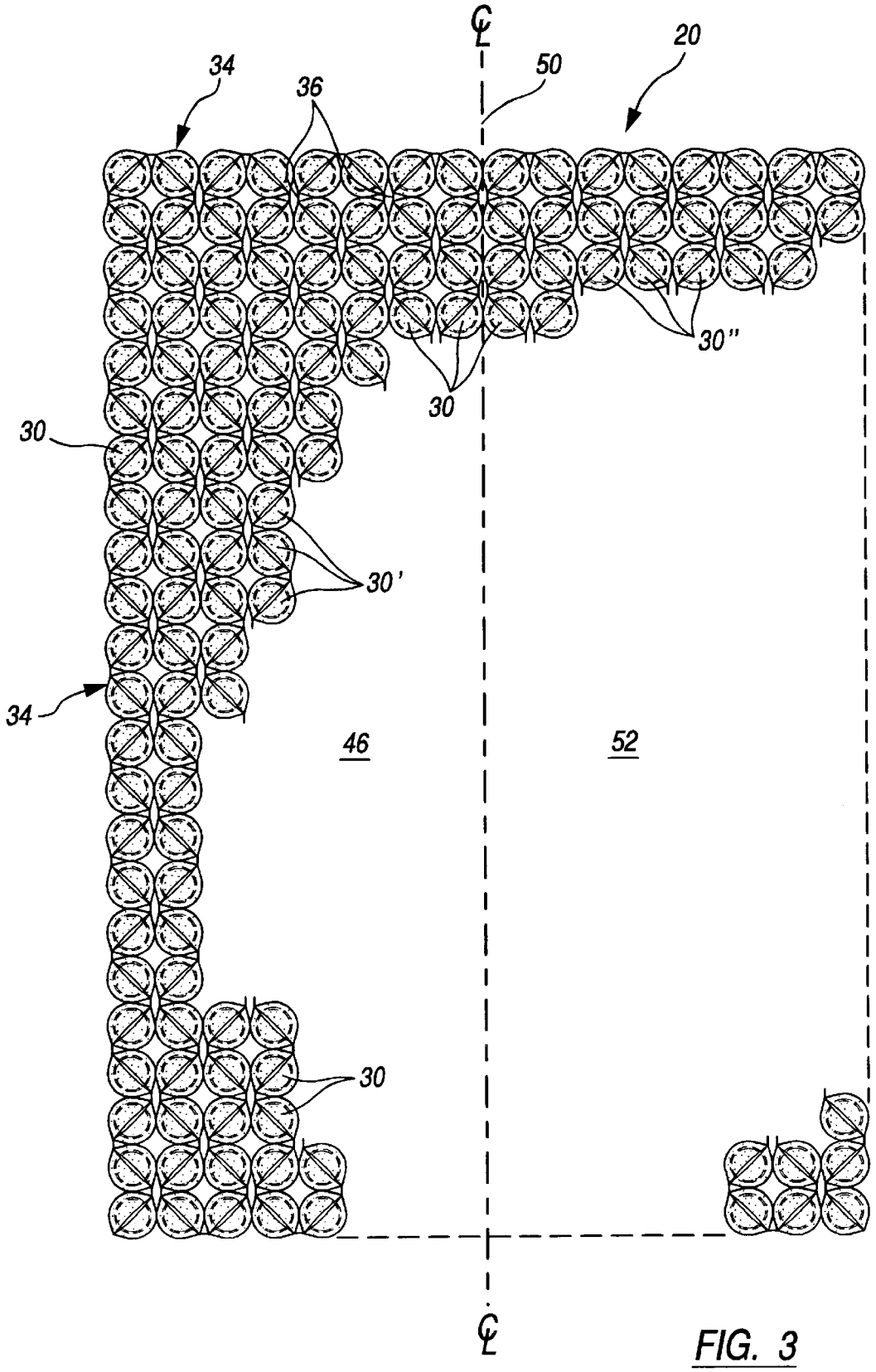
FIG. 3 is a top plan view of the innerspring assembly shown in the mattress of FIG. 1.

The complete innerspring core 20 can best be seen in the plan view of FIG. 3. Strings 34 of pocketed coils 30 of suitable length are arranged in a closely packed array to define the core 20. In a manner well-known in the art, multiple strings 34 may be arranged in a chevron configuration with adjacent strings 34 glued together to retain the generally rectangular shape of the core 20.

In accordance with the invention, the innerspring core 20 is constructed using coil springs 30 having different compressive strengths or stiffnesses. For example, springs 30' of a first stiffness may be assembled into a first strings 34 of coils 30 defining a first region 46 of the core 20, which as illustrated in FIG. 3, comprises half of the core 20 lying to the left side of center line 50. Similarly, coil springs 30" of a second stiffness different from the stiffness of the coil springs 30' are assembled into second strings 34 of coils 30 to define a second region 52 of the core 20 lying to the right side of center line 50 as viewed in FIG. 3. This construction permits the mattress 16 to have a single innerspring core 20 with two halves of differing firmness without requiring an assembly in which two separate cores are needed.

Moreover, the mattress assembly 16 of the present invention comprises a unitary innerspring core assembly 20 which exteriorly resembles a conventional mattress innerspring and has no gaps or cracks in it which could be uncomfortable to the users thereof. In a preferred form, the coil springs 30 of one entire half of the mattress 16 may be formed of steel wire having a diameter of 0.063 inch while the adjacent half may have springs 30 formed of wire having a diameter of 0.083 inch. This construction provides for a discernable difference in firmness as between the two halves and is suitable for accommodating the preferences of two people.

Although one form of the invention may be a mattress innerspring assembly having two regions or sectors of differing firmness, it can be appreciated that an innerspring assembly can be constructed having any number of differing firmness sectors to suit the particular preferences of the user or users. Thus, for example, differing firmness sectors may be arranged lengthwise of the innerspring to provide varying degrees of support for the head, torso or legs of the user. Moreover, the sectors can be of any size relative to the overall size of the innerspring assembly. Thus if one user, for example, desires certain firmness characteristics over a greater portion of the mattress than another user desires, an innerspring assembly can be constructed accordingly.

While the present invention has been described in connection with a preferred embodiment thereof, it will be understood by those skilled in the art that many changes and modifications may be made without departing from the true spirit and scope of the present invention. Accordingly, it is intended by the appended claims to cover all such changes and modifications which come within the spirit and scope of the invention, such as unitary mattresses having greater than two firmness regions therein situated to accommodate the desires and preferences of the product.

What is claimed is:

1. A unitary mattress assembly comprising:

a plurality of strings of pocketed coil springs arranged to define a unitary mattress core structure with each of said pocketed coil springs having a discrete compressive strength, each of said strings being positioned in substantially parallel alignment to each of the other plurality of strings of pocketed coil springs with the longitudinal top ends of all the pocketed coil springs lying in a substantially common plane perpendicular to the longitudinal axes of said pocketed coil springs to provide a top planar mattress surface defined by said ends of said springs; and said pocketed coil springs in said plurality of strings being selectively positioned in said mattress core so that spring coils having a particular compressive strength are arranged to provide a first firmness sector within the mattress core and spring coils having another compressive strength are arranged to provide a second firmness sector within the mattress core, said first and second sectors being adjacent to one another and disposed on opposite sides of an imaginary line dividing said assembly longitudinally substantially into two halves, the strings of pocketed coil springs on opposite sides of said imaginary dividing line being connected directly together along said line without a discontinuity in said unitary mattress core between said first and second firmness sectors, whereby varying firmness characteristics are exhibited at two distinct portions of said planar mattress surface to accommodate the different comfort preferences of two simultaneous users.

2. The mattress assembly of claim 1 including a cover disposed adjacent to the top planar mattress surface and substantially coextensive with said core providing a generally planar surface on top of said core.

3. The mattress assembly of claim 1 wherein the springs of said first sector are formed from steel wire having a diameter of about 0.063 inch and the springs of said second sector are formed from steel wire having a diameter of about 0.083 inch.

4. A method of constructing a mattress assembly comprising the steps of:

forming a plurality of first coil springs having a first compressive strength;

forming a plurality of second coil springs having a compressing strength which is different from said first compressive strength;

forming a first string of interconnected fabric pockets each pocket dimensioned and configured to receive either of said first or second coil springs;

forming a second string of interconnected fabric pockets each pocket dimensioned and configured to receive either of said first or second coil springs;

inserting said first springs into the pockets of said first fabric string;

inserting said second springs into the pockets of said second fabric string;

arranging said strings in a configuration to define a unitary mattress core having a generally rectangular shape in plan with longitudinal axes of the springs oriented substantially parallel one to another with ends of the springs all lying in a common plane and wherein said first string is so arranged to define a first discrete portion of said mattress core disposed on one side of an imaginary line dividing said core longitudinally substantially into two halves and wherein said second string is so arranged to define a second discrete portion of said mattress core disposed on the other side of said imaginary longitudinal line, the strings of pocketed coil springs on opposite sides of said line being connected directly together along said line without a discontinuity in said mattress core between said portions of said mattress core, whereby two distinct portions of said mattress core are provided having varying firmness characteristics to accommodate the different comfort preferences of two simultaneous users.

5. The method of claim 4 including the step of installing a pad of soft, resilient material on top of the mattress core such that the pad is substantially coextensive with said arrangement of said strings of coil springs.

* * * * *